US007553082B2

(12) United States Patent
Yoder

(10) Patent No.: US 7,553,082 B2
(45) Date of Patent: Jun. 30, 2009

(54) EVACUABLE STORAGE BAG HAVING RESEALABLE MEANS ACTIVATED BY SLIDER

(75) Inventor: Randall Wayne Yoder, Steger, IL (US)

(73) Assignee: Illinois Tool Works Inc., Glenview, IL (US)

( * ) Notice: Subject to any disclaimer, the term of this patent is extended or adjusted under 35 U.S.C. 154(b) by 525 days.

(21) Appl. No.: 10/910,724

(22) Filed: Aug. 3, 2004

(65) Prior Publication Data

US 2006/0029300 A1 Feb. 9, 2006

(51) Int. Cl.
*B65D 33/16* (2006.01)

(52) U.S. Cl. ..... 383/64; 383/61.1; 383/61.2; 383/95; 383/210.1; 383/211

(58) Field of Classification Search ..... 383/64, 383/210–211, 61.2, 59, 95, 64.1, 61.1; 24/399–400
See application file for complete search history.

(56) References Cited

U.S. PATENT DOCUMENTS 4,786,190 A * 11/1988 Van Erden et al. ..... 383/203
4,832,505 A * 5/1989 Ausnit et al. ..... 383/5
5,140,796 A * 8/1992 Pope ..... 53/390
5,238,306 A * 8/1993 Heintz et al. ..... 383/210.1
5,346,301 A * 9/1994 Scarberry et al. ..... 383/5
5,638,586 A * 6/1997 Malin et al. ..... 24/585.12
5,682,730 A * 11/1997 Dobreski ..... 53/469
5,832,145 A * 11/1998 Dais et al. ..... 383/211
6,341,688 B1 * 1/2002 Graham ..... 206/63.5

(Continued)

FOREIGN PATENT DOCUMENTS

EP 1088768 A2 * 4/2001

(Continued)

OTHER PUBLICATIONS

Patent Abstracts Of Japan vol. 2000, No. 22, Mar. 9, 2001—JP 2001 130595 A (Kaneshiro Teruyuki; Sanroora:KK), May 15, 2001 abstract.

(Continued)

*Primary Examiner*—Nathan J Newhouse
*Assistant Examiner*—Jack H Morgan, Jr.
(74) *Attorney, Agent, or Firm*—Ostrager Chong Flaherty & Broitman P.C.

(57) ABSTRACT

A storage bag comprises: first and second panels joined or connected on three sides and having a mouth on a fourth side; a pair of zipper strips respectively joined to the first and second panels in the region of the mouth, each zipper strip comprising respective upper and lower zipper profiles; resealable means joined to at least one of the zipper strips in a region between the upper and lower zipper profiles; and a slider that pushes the respective pairs of zipper profiles together and reseals the resealable means as the slider travels along the mouth of the bag. In one embodiment, the resealable means comprise a layer of adhesive material that adheres to the base web of the opposing zipper strip as the moving slider presses the adhesive material and base web together. In another embodiment, the resealable means comprise first and second layers of cohesive material that cohere to each other as the moving slider presses the layers of cohesive material together.

10 Claims, 4 Drawing Sheets

U.S. PATENT DOCUMENTS

| | | | | |
|---|---|---|---|---|
| 6,467,957 | B2 * | 10/2002 | Yeager | 383/211 |
| 6,609,827 | B2 * | 8/2003 | Bois et al. | 383/59 |
| 7,036,988 | B2 * | 5/2006 | Olechowski | 383/210.1 |
| 2002/0034343 | A1 * | 3/2002 | Bois | 383/59 |
| 2002/0034344 | A1 | 3/2002 | Bois | |
| 2003/0015452 | A1 * | 1/2003 | Su | 206/524.8 |
| 2003/0077007 | A1 | 4/2003 | Turvey et al. | |
| 2003/0167607 | A1 * | 9/2003 | Linton | 24/585.12 |
| 2004/0001650 | A1 * | 1/2004 | Piechocki et al. | 383/59 |
| 2004/0010893 | A1 | 1/2004 | Kasai | |

FOREIGN PATENT DOCUMENTS

| | | |
|---|---|---|
| WO | WO 02/26578 A | 4/2002 |

OTHER PUBLICATIONS

Patent Abstracts of Japan vol. 1995, No. 11, Dec. 26, 1995—JP 07 223657 A (Teruyuki Kaneshiro), Aug. 22, 1995 abstract.

* cited by examiner

EVACUABLE STORAGE BAG HAVING RESEALABLE MEANS ACTIVATED BY SLIDER

BACKGROUND OF THE INVENTION

This invention generally relates to storage bags having slider-operated zippers. In particular, the invention relates to evacuable reclosable storage containers having a slider that closes but cannot open the zipper.

Collapsible, evacuable storage containers typically include a flexible, airtight bag, an opening through which an article is inserted inside the bag, a zipper for closing the opening and hermetically sealing the bag, and a fixture through which excess air is evacuated from the bag. A user places an article into the bag through the opening, seals the opening, and then evacuates the air in the bag through the fixture. With the bag thus evacuated, a compressible article contained therein may be significantly compressed so that it is easier to transport and requires substantially less storage space.

Collapsible, evacuable storage containers are beneficial for reasons in addition to those associated with compression of the stored article. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

Not only large, compressible items such as clothing may be stored in a collapsible, evacuable storage container. For example, it may be desirable to store bulk items made of small particles, such as powders or granulated resins, in an evacuated container. One situation that commonly occurs is that a particular bulk item is shipped in a large, rigid container such as a drum. Bulk items may be moisture sensitive and are sealed against moisture during shipment. But many times a user does not need to use the entire contents of the large container, and so once exposed to air the remaining bulk contents quickly become unusable and are thus wasted.

One collapsible, reusable, evacuable storage container is shown in U.S. Pat. No. 5,480,030. This patent discloses a bag that is reclosable by means of a plastic zipper and that is evacuable via a one-way air valve assembly having a flexible diaphragm that seals against a valve seat. The valve assembly also has vanes positioned to prevent the bag material or bag contents from obstructing air holes or the diaphragm while air is being evacuated through the valve assembly.

Many commercially available evacuable storage bags are provided with an inverted U-shaped slider or clip mounted to the plastic zipper. This slider is capable of closing an open zipper, i.e., by camming the opposing zipper strips into engagement during slider travel in either direction, but cannot be used to open a closed zipper. The slider does not have means for opening the zipper because typically such means would leave a gap in the zipper, thereby preventing formation of a hermetic seal.

There is a continuing need for improvements in the design of evacuable storage bags.

BRIEF DESCRIPTION OF THE INVENTION

The present invention is directed to evacuable bags having resealable means that are resealed as a moving slider closes a zipper installed in the mouth of the bag.

One aspect of the invention is a storage bag comprising: first and second panels joined or connected on three sides and having a mouth on a fourth side; a pair of zipper strips having respective upper and lower zipper profiles respectively joined to the first and second panels in the region of the mouth; resealable means joined to at least one of the first and second zipper strips in a region between the upper and lower zipper profiles; and a slider mounted to the zipper strips, the slider being designed to push the respective pairs of zipper profiles together and reseal the resealable means as the slider travels along the mouth of the bag.

Another aspect of the invention is a storage bag comprising: a receptacle having an interior volume and a mouth, the receptacle comprising first and second panels; a first flexible plastic zipper strip comprising a first base web and first and second zipper profiles respectively joined or connected to the first base web, the first and second zipper profiles being mutually parallel, and the first base web being joined to the first panel in a region extending along the mouth; a second flexible plastic zipper strip comprising a second base web and third and fourth zipper profiles respectively joined or connected to the second base web, the third and fourth zipper profiles being mutually parallel, the second base web being joined to the second panel in a region extending along the mouth, the first and second zipper strips being in mutual opposition with the first zipper profile aligned with and engageable with the third zipper profile along the entire length of the mouth, and with the second zipper profile aligned with and engageable with the fourth zipper profile along the entire length of the mouth; resealable means applied on a surface of the first base web in a region between the first and second zipper profiles; and a generally U-shaped slider slidably mounted to the mouth and designed to cam the first and third zipper profiles into mutual engagement, to cam the second and fourth zipper strips into mutual engagement and to reseal of the resealable means during slider travel in either direction along the mouth, the slider comprising mutually opposing first and second sidewalls, and a bridge connecting the first and second sidewalls.

A further aspect of the invention is a storage bag comprising: a receptacle comprising first and second panels that are either joined or connected to each other along three sides of a quadrilateral; a first flexible plastic zipper strip comprising a first base web and first and second zipper profiles respectively joined or connected to the first base web, the first and second zipper profiles being mutually parallel, and the first base web being joined to the first panel in a region extending along the mouth; a second flexible plastic zipper strip comprising a second base web and third and fourth zipper profiles respectively joined or connected to the second base web, the third and fourth zipper profiles being mutually parallel, the second base web being joined to the second panel in a region extending along the mouth, the first and second zipper strips being in mutual opposition with the first zipper profile aligned with and engageable with the third zipper profile along the entire length of the mouth, and with the second zipper profile aligned with and engageable with the fourth zipper profile along the entire length of the mouth; a layer of adhesive material applied on a surface of the first base web in a region between the first and second zipper profiles; and a generally U-shaped slider slidably mounted to the mouth and designed to cam the first and third zipper profiles into mutual engagement, to cam the second and fourth zipper strips into mutual engagement and to cam the layer of adhesive material and the second base web into a state of adhesion during slider travel in either direction along the mouth, the slider comprising mutually opposing first and second sidewalls, and a bridge connecting the first and second sidewalls.

Yet another aspect of the invention is a storage bag comprising: a receptacle comprising first and second panels that are either joined or connected to each other along three sides of a quadrilateral; a first flexible plastic zipper strip comprising a first base web and first and second zipper profiles respectively joined or connected to the first base web, the first and second zipper profiles being mutually parallel, and the first base web being joined to the first panel in a region extending along the mouth; a second flexible plastic zipper strip comprising a second base web and third and fourth zipper profiles respectively joined or connected to the second base web, the third and fourth zipper profiles being mutually parallel, the second base web being joined to the second panel in a region extending along the mouth, the first and second zipper strips being in mutual opposition with the first zipper profile aligned with and engageable with the third zipper profile along the entire length of the mouth, and with the second zipper profile aligned with and engageable with the fourth zipper profile along the entire length of the mouth; a first layer of cohesive material applied on a surface of the first base web in a region between the first and second zipper profiles; a second layer of cohesive material applied on a surface of the second base web in a region between the third and fourth zipper profiles and opposite the first layer of cohesive material; and a generally U-shaped slider slidably mounted to the mouth and designed to cam the first and third zipper profiles into mutual engagement, to cam the second and fourth zipper strips into mutual engagement and to cam the first and second layers of cohesive material into a state of cohesion during slider travel in either direction along the mouth, the slider comprising mutually opposing first and second sidewalls, and a bridge connecting the first and second sidewalls.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
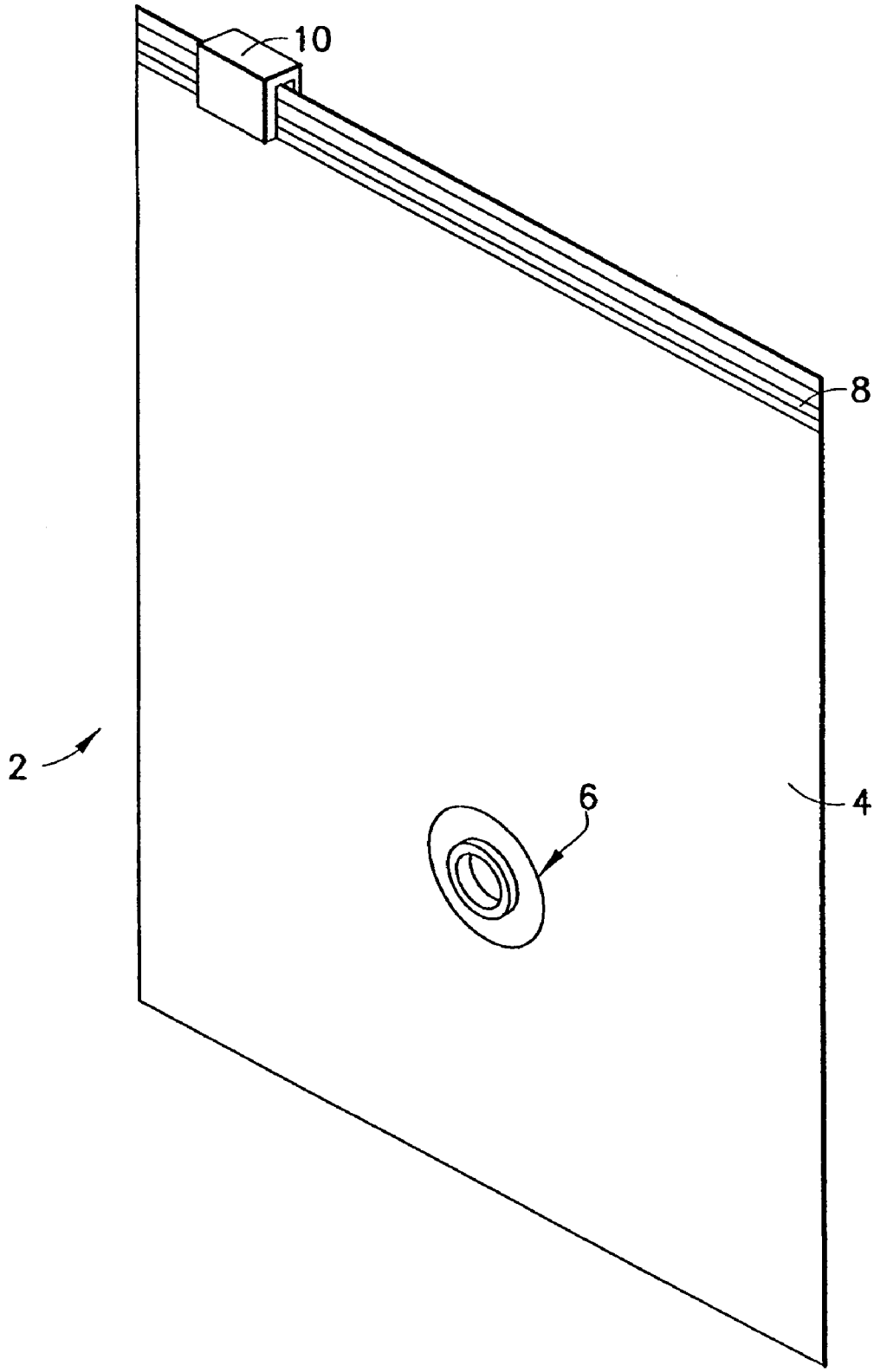
FIG. 1 PRIOR ART
FIG. 1 is a drawing showing an isometric view of one conventional type of collapsible, evacuable storage container.

FIG. 1 shows a conventional collapsible, evacuable storage container 2 comprising a bag 4, a valve assembly 6, and a zipper 8 comprising a pair of mutually interlockable extruded zipper strips that are joined to each other at opposing ends thereof. The bag 4 typically comprises front and rear walls or panels (made, e.g., of thermoplastic film material) that are joined together at the bottom and two sides by conduction heat sealing to form a receptacle having an interior volume and a mouth in which the zipper 8 is installed. The ends of the zipper strips can be crushed and fused together to form a zipper with joined ends. One wall of bag 4 has a hole (not shown in FIG. 1) in which to install the valve assembly 6. Alternatively, the bag 4 may be made from a web of film that is folded, the fold forming the bottom of the bag.

Figure 4:
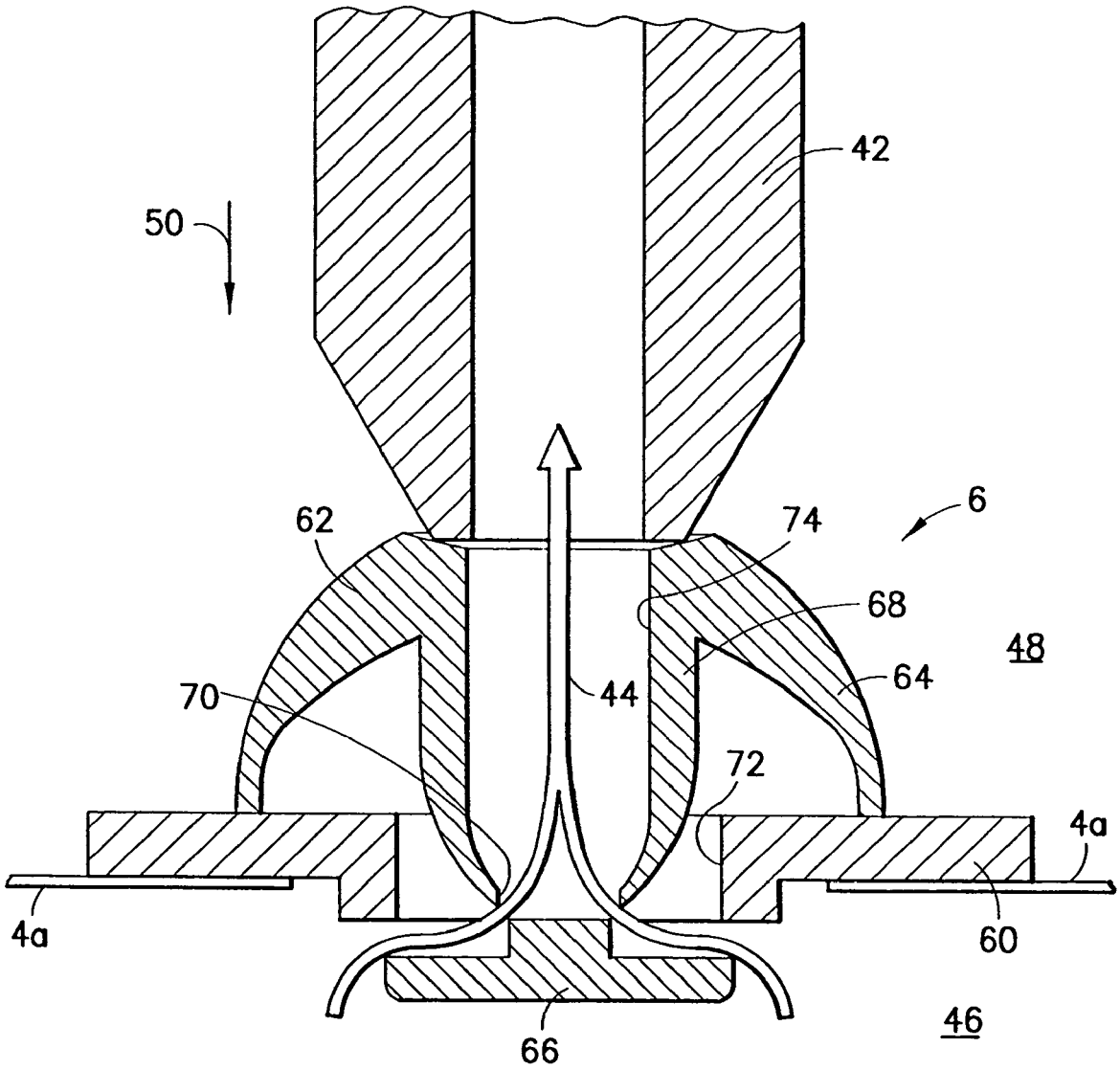
FIG. 4 is a drawing showing a sectional view of a valve assembly suitable for incorporation in the storage bags disclosed herein.

The valve assembly 6 is mounted in the front wall of the bag so that an airtight seal is formed between the periphery of the valve assembly and the adjacent and surrounding peripheral edge of the aperture in the film. Any suitable valve assembly may be used. One example of a suitable valve assembly 6 is shown in FIG. 4. That valve assembly comprises a base 60 having a hole therethrough and a contact surface disposed along a periphery of the hole, and further comprises a valve 62 coupled to the base for opening the hole in a first state and closing the hole in a second state. The valve 62 comprises a resilient cap 64 disposed on one side of the base 60, a gate 66 disposed on the other side of the base 60, and a stem 68 connecting the cap 64 to the gate 66. The cap 64 has an opening, the stem 68 has a cavity in fluid communication with the opening in the cap 64 and at least one opening 70 in fluid communication with the cavity and an exterior of the stem 68, and the gate 66 is configured to contact the contact surface of the base 60 to close the hole in the base when the cap 64 is in a first, i.e., undeformed, state and to separate at least partially from the surface to open the hole in the base 60 at least partially when the cap 64 is in a second, i.e., deformed, state. When the cap 64 is deformed, the opening in the cap is in fluid communication with a space on the other side of the base 60 via the opening 70 in the stem and the cavity in the stem.

Still referring to FIG. 4, the deformation of cap 64 is achieved by pressing the tip of a nozzle 42 against the cap 64 of valve assembly 6 (in the direction indicated by arrow 50), causing the gate 66 to separate from the base 60, thereby allowing fluid communication between the interior 46 and the exterior 48 of the bag. The nozzle 42 is connected to an exhaust port of a vacuum source (e.g., a vacuum pump) by means of a flexible tube (not shown). During evacuation, the interior of the bag is in fluid communication with the vacuum source via the open valve 62 of the valve assembly 6, the nozzle 42 and the flexible tube connected in series. When the valve 62 is open, the vacuum source draws air from the interior 46 of the bag (indicated by arrow 44 in FIG. 4), thereby forming a vacuum inside the bag. The absence of air and moisture inside the evacuated bag preserves any perishable item(s), such as food or other material that is better preserved when not exposed to moisture or air.

The bag-making film may be made of any air-impermeable material suitable for storing food for human consumption, such as polyethylene or nylon/polyethylene laminate. The components of the valve assembly may be formed by conventional injection molding, and may be formed of material such as polyethylene, polyvinylchloride, acrylonitrile-butadiene-styrene or other suitable material.

When the nozzle 42 is removed from the cap of the valve assembly 6, the cap recovers its undeformed shape (not shown in FIG. 4). The resilient force exerted by the cap 64 pulls the gate 66 upwards against the base 60, again forming an airtight seal.

Figure 2:
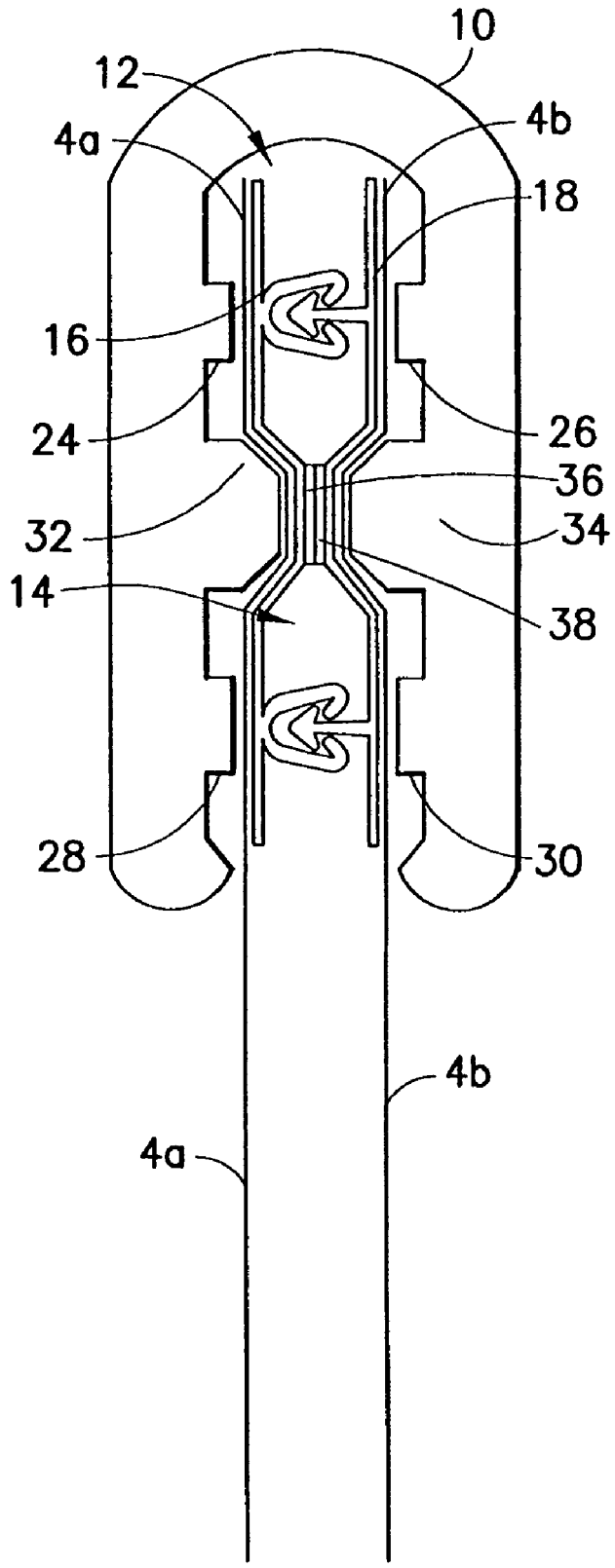
FIG. 2 is a drawing showing a cross-sectional view of the mouth of an evacuable bag in accordance with one embodiment of the invention.
Figure 3:
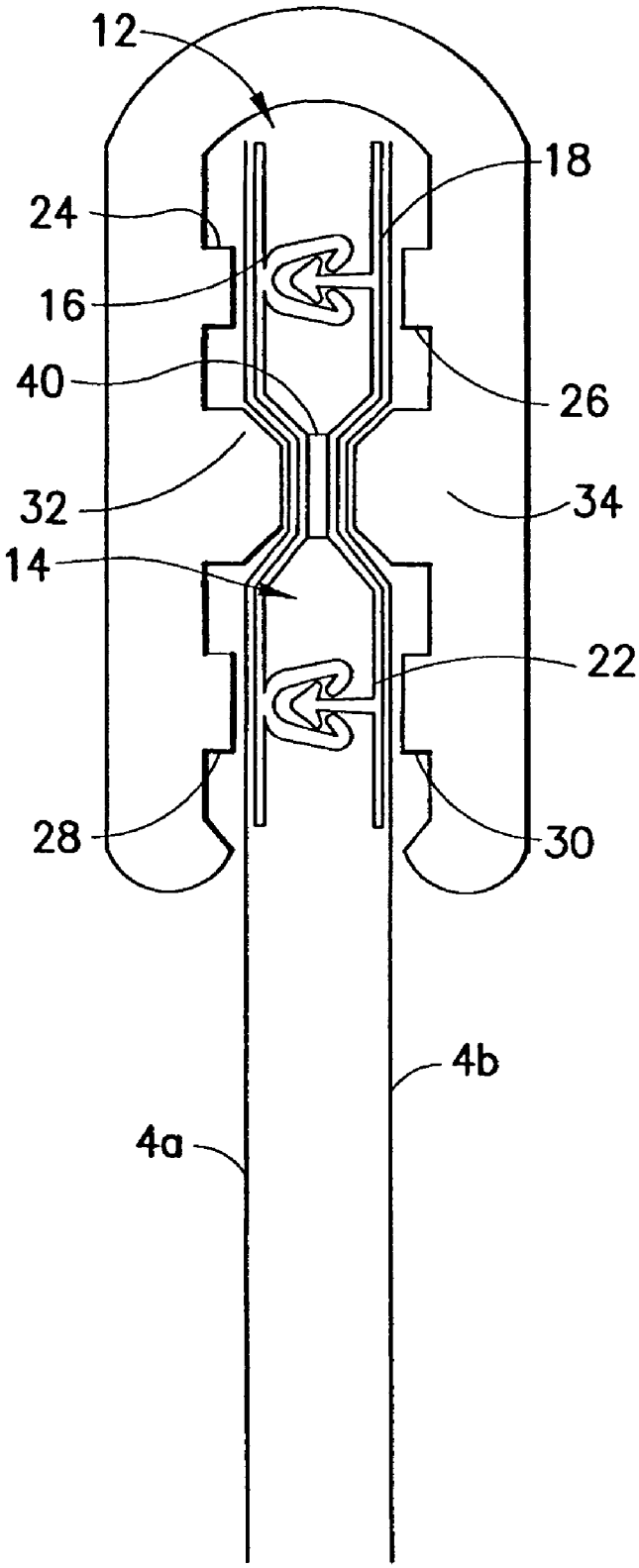
FIG. 3 is a drawing showing a cross-sectional view of the mouth of an evacuable bag in accordance with another embodiment of the invention.

Referring again to FIG. 1, an extruded plastic zipper is installed in the mouth of the package. The zipper comprises a pair of interlockable fastener or zipper strips 16 and 18. In general, the interlocking profiles of the zipper strips may take any form. For example, the zipper may comprise interlocking rib and groove elements or alternating hook-shaped closure elements. Closure profiles of the rib-and-groove variety are used in the embodiments shown in FIGS. 2 and 3. The rib may have any profile that can be retained by the opposing lips at the mouth of the groove, e.g., triangular, trapezoidal, semicircular, and so forth. As shown in FIGS. 2 and 3, zipper strip 16 comprises a base web and a pair of female closure profiles that are mutually parallel when the base web is flat and spaced apart, while zipper strip 18 comprises a base web and a pair of male closure profiles that are received in and interlock with the female closure profiles respectively. Zippers having the structures shown in FIGS. 2 and 3 are disclosed in U.S. patent application Ser. No. 10/370,310, entitled "Zipper for Vacuum Storage Bag". The preferred zipper material is polyethylene. However, a different plastic material, such as polypropylene, could be used. Although not shown in FIGS. 2 and 3, the zipper strips 16 and 18 are joined at opposite ends of the zipper, for example, by fusing the confronting ends of the zipper strips together by application of heat.

The zipper strip 16 is joined to the upper marginal portion of the front wall 4*a* and the zipper strip 18 is joined to the upper marginal portion of the rear wall 4*b*, e.g. by means of respective layers of sealant material (not shown in FIG. 4) laminated to the backs of the base webs. This is typically accomplished by co-extruding the zipper strip and the sealant layer. The front and rear bag wall panels are respectively sealed to the zipper strips by heat fusion or welding (also referred to as "heat sealing"). Alternatively, the interlockable zipper strips can be attached to the wall panels by adhesive or bonding strips or the zipper profiles can be extruded integrally with the bag material.

During use, one or more discrete articles or a bulk material (not shown) may be placed inside the bag 4 while the zipper 8 is open, i.e., while the closure profiles of the interlockable zipper strips are disengaged from each other. After the article or material to be stored has been placed inside the bag, the mouth of the bag 4 can be sealed by pressing the zipper strips together to cause their respective closure profiles to interlock with each other. Although the zipper closure profiles may have many different designs, the design must be one that ensures that an airtight seal can be formed at the mouth of the bag. (The profiles do not provide an airtight seal; the pressure-sensitive adhesive/cohesive layer does.) After the zipper has been closed, the interior volume of the bag can be evacuated by sucking air out via the one-way valve assembly 6. Air can be drawn out of bag 4 through valve assembly 6 using a conventional vacuum source, as previously described. The valve assembly 6 and the zipper 8 maintain the vacuum inside bag 4 after the vacuum source is removed.

In accordance with one embodiment of the invention shown in FIG. 2, the evacuable bag further comprises cohesive means for hermetically sealing the zipper. The cohesive hermetic sealing means comprise a first layer 36 of cohesive material applied on the base web of zipper strip 16 as a coating on a central zone between the female profiles, and a second layer 38 of cohesive material applied on base web of zipper strip 18 as a coating on a central zone between the male profiles. A cohesive material is a tacky material that sticks with greater cohesive strength to itself than to other materials. Thus, the cohesive coating must be joined to the zipper, e.g., by means of an intervening layer of adhesive (not shown), or by treating the surfaces of the zipper strips 16, 18, or by co-extruding with the zipper strips 16, 18. The cohesive coatings are continuously applied along the entire length of the zipper strips 16 and 18. The hermetic seal is achieved by pressing the base webs of zipper strips 16 and 18 together along the entire length of the region disposed between the closure profiles. The coating 36 will cohere to the coating 38 (this state of cohesion is not shown in FIG. 2), forming a hermetic seal along the entire length of the mouth of the package. When the zipper strips 16 and 18 are later pulled apart, the cohesive coatings will peel away from each other.

In accordance with an alternative embodiment shown in FIG. 3, the hermetic sealing means comprise a layer 40 of pressure-sensitive adhesive material applied on the base web of one of the zipper strips 16 or 18. The adhesive material is applied as a coating on a central zone of the zipper strip, between the zipper profiles. A pressure-sensitive adhesive is an adhesive that develops maximum bonding power when applied by a light pressure. The pressure-sensitive coating is joined to either of the zipper strips 16 or 18 by means of an intervening layer of adhesive (not shown). The adhesive coating is continuously applied along the entire length of the zipper strip. Again, the hermetic seal is achieved by pressing the base webs of the zipper strips 16 and 18 together along the entire length of the central region between the closure profiles. When sufficient pressure is applied, the pressure-sensitive adhesive coating 40 will adhere to a central region of the other zipper strip, forming a hermetic seal along the entire length of the mouth of the package. When the zipper strips 16 and 18 are later pulled apart, the pressure-sensitive adhesive coating 40 will peel away from the zipper strip it is adhered to and will remain on the zipper strip to which it is joined.

The zipper strips can be pressed together using a device 10 commonly referred to as a "slider" or "clip", which straddles the zipper. The typical slider has a generally U-shaped profile, with respective legs disposed on opposing sides of the zipper. The gap between the slider legs is small enough that the zipper can pass through the slider gap only if the zipper is in a closed state. Thus when the slider is moved along an open zipper, this has the effect of pressing the incoming sections of the zipper strips together. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A slider in accordance with one embodiment of the invention is shown in FIGS. 2 and 3. As seen in FIG. 2, the slider 10 is generally U-shaped and comprises mutually opposing sidewalls and a bridge that connects the sidewalls. The sidewalls are separated by a gap of varying width. The slider gap 24 narrows in width at confronting generally parallel planar surfaces of respective pairs of opposing plateaus. As seen in FIG. 2 (the slider in FIG. 3 has the same structure), the slider 10 comprises a first pair of plateaus 24 and 26 that project inwardly toward each other from the first and second sidewalls respectively, and a second pair of plateaus 28 and 30 that project inwardly toward each other from the first and second sidewalls respectively. During slider travel in either direction along the zipper, plateaus 24 and 26 cam or push the upper male and female zipper profiles into mutual interlocking engagement, while plateaus 28 and 30 cam or push the lower male and female zipper profiles into mutual interlocking engagement. In other words, the zipper profiles can pass through the gap between the respective pairs of opposing plateaus only if the zipper profiles are interlocked, i.e., that section of the zipper is closed. In addition, the slider comprises a third pair of plateaus 32 and 34 that project inwardly toward each other from the first and second sidewalls respectively. During slider travel in either direction along the zipper, plateaus 32 and 34 cam or push the layers 36 and 38 of cohesive material into mutual contact, causing the cohesive layers to cohere to each other. When the slider traverses the entire length of the bag mouth, the cohered layers of cohesive material form a hermetic seal that helps to maintain a subsequent evacuated state inside the bag.

In the embodiment depicted in FIG. 3, the slider operates in a similar manner, presses the zipper profiles together into mutual engagement and pressing the layer 40 of adhesive material against the confronting portion of the base web of the zipper strip that the adhesive layer 40 is not already joined to. More precisely, during slider travel in either direction along the zipper, plateaus 32 and 34 cam or push the layer 40 of adhesive material into contact with the confronting base web of the opposite zipper strip, causing the adhesive layer to adhere thereto. When the slider traverses the entire length of the bag mouth, the adhered layer of adhesive material forms a hermetic seal that helps to maintain a subsequent evacuated state inside the bag.

A zipper strip having a coating made of adhesive or cohesive material may be manufactured by co-extruding the zipper strip to have a sealant layer on the exterior side and applying a layer of adhesive or cohesive material of predetermined width onto the interior side of the moving zipper part in a region between the two zipper profiles. The adhesive or cohesive material can be applied by ultrasonic spraying. The sealant layer facilitates joinder of the zipper strip to the bag-making film. Both zipper strips can be made in one process by extruding a structure comprising a base web, two male profiles on one half of the base web, and two female profiles on the other half of the base web, applying the adhesive or cohesive material to the base web, and then slitting the base web in half to sever the connected zipper strips. A layer of sealant material can be co-extruded on the back of the base web. After slitting, the sealant material on the backs of the respective base webs of the zipper strips are joined to respective portions of bag making film by conventional conduction heat sealing.

The zipper strips employed in the evacuable bags disclosed herein can be manufactured using a process similar to that disclosed in U.S. Pat. No. 6,080,252. Alternatively, the zipper strips could be produced by extruding the zipper profiles integrally with the base web, or the zipper profiles could be applied to a base web that was manufactured at an earlier date. In accordance with the process disclosed in U.S. Pat. No. 6,080,252, a base web is extruded by a first die; then the four zipper profiles are extruded by respective profile dies. The extruded base web is deposited onto the top surface of a continuous carrier web in an area generally supported by a cast roller. A sealant material may be co-extruded onto one surface of the base web before depositing the base web onto the carrier web. The carrier web forms an endless loop around the cast roller, a driving roller and a stripping roller and is driven by the driving roller. The latter is driven by an electric motor or other driving means. An adjusting/steering roller is provided between the stripping roller and cast roller to adjust and maintain the tension of carrier web, as taught in U.S. Pat. No. 6,080,252. The carrier web may be made of a suitable material, such as Teflon, to which the base web will not adhere, or may be conditioned to prevent adherence or slippage. The top surface of carrier web may have a texture, such as a grid-like texture. The particular texture of the carrier web is imparted to the base web to increase the capability of the base web to bond to a substrate in such intended applications as reclosable plastic bags. At least the top surface of the carrier web may also have a treatment to provide adequate adhesion so that base web does not intermittently slip and reattach to the carrier web, and to allow release of the base web at the stripping point as described below. The treatment may consist of raising or lowering the temperature of the carrier web at specific points to facilitate such adhesion and detachment, or the treatment may be application of a release agent to the top surface of the carrier web prior to depositing the base web thereon.

Next, the zipper profiles are deposited onto the top surface of the base web. While the material selected for the base web may differ from the material selected for the zipper profiles, the materials selected should permit the profiles to bond with the base web. Then the base web and profiles are cooled by an adjusting/cooling nozzle, thereby stabilizing and setting the base web and profiles. Water may be ejected from the adjusting/cooling nozzle to cool the base web and profiles. The carrier web is disposed vertically between the cast roller and the driving roller, which ensures that any water deposited on the base web and/or profiles during cooling will be removed. While the base web and zipper profiles are carried by the carrier web, no tensile forces are imparted on the base web or profiles to guide them through the apparatus. Thus, deformation of the base web and profiles is avoided. Finally, the base web and profiles are stripped from the carrier web at a stripping point located in the general area where the path of the carrier web turns about the stripping roller. The base web/profiles, after being stripped from the carrier web, are guided through a nip formed by a pair of take-off rollers for slitting and attachment to bag making film.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, welded, bonded, sealed, adhered, etc., whether by application of heat and/or pressure, application of ultrasonic energy, application of a layer of adhesive material or bonding agent, interposition of an adhesive or bonding strip, co-extrusion (e.g., of zipper profiles and zipper base web, or zipper to bag making film), etc.

The invention claimed is:

1. A storage bag comprising:

first and second panels joined or connected on three sides and having a mouth on a fourth side;

first and second zipper strips having respective upper and lower zipper profiles projecting from a respective base web, said base webs of said first and second zipper strips being respectively joined to said first and second panels in the region of said mouth, said upper zipper profiles of said first and second zipper strips being mutually interlockable to form a first closure and said lower zipper profiles of said first and second zipper strips being mutually interlockable to form a second closure, said first and second zipper strips not having any other zipper profile disposed between said respective upper and lower zipper profiles;

resealable means covering and in contact with a band-shaped section of the surface of said base web of at least one of said first and second zipper strips in a region between the upper and lower zipper profiles and having a flat profile, said band-shaped section extending across said mouth; and a slider mounted to said zipper strips, said slider comprising first and second contact surfaces separated by a first gap and having respective portions of said upper zipper profiles disposed therebetween, third and fourth contact surfaces separated by a second gap and having respective portions of said resealable means disposed therebetween, and fifth and sixth contact surfaces separated by a third gap and having respective portions of said lower zipper profiles disposed therebetween, wherein as the slider travels along the mouth of the bag, said first and second contact surfaces cam said upper zipper profiles into a mutually interlocked state to close said first closure, said third and fourth contact surfaces cooperate to reseal said resealable means, and said fifth and sixth contact surfaces cam said lower zipper profiles into a mutually interlocked state to close said second closure, wherein said resealable means comprise first and second layers of cohesive material applied on said first and second zipper strips respectively, said first layer of cohesive material covering and in contact with a band-shaped section of the surface of said base web of said first zipper strip in a region between the upper and lower zipper profiles of said first zipper strip and said second layer of cohesive material covering and in contact with a band-shaped section of the surface of said base web of said second zipper strip in a region between the upper and lower zipper profiles of said second zipper strip, wherein said third and fourth contact surfaces cam said first and second layers of cohesive material into a state of cohesion during slider travel in either direction along said mouth, and wherein said slider comprises mutually opposing first and second sidewalls connected by a bridge, and further comprises first, third and fifth plateaus projecting inwardly from said first sidewall, and second, fourth and sixth plateaus projecting inwardly from said second sidewall, said first through sixth contact surfaces being respectively disposed on said first through sixth plateaus.

2. The storage bag as recited in claim 1, further comprising a one-way valve assembly installed in an aperture in one of said first and second panels.

3. A storage bag comprising:

a receptacle having an interior volume and a mouth, said receptacle comprising first and second panels;

a first flexible plastic zipper strip comprising a first base web and first and second zipper profiles respectively joined or connected to said first base web, said first and second zipper profiles being mutually parallel, said first zipper strip not having any other zipper profile disposed between said first and second zipper profiles, and said first base web being joined to said first panel in a region extending along said mouth;

a second flexible plastic zipper strip comprising a second base web and third and fourth zipper profiles respectively joined or connected to said second base web, said third and fourth zipper profiles being mutually parallel, said second zipper strip not having any other zipper profile disposed between said third and fourth zipper profiles, said second base web being joined to said second panel in a region extending along said mouth, said first and second zipper strips being in mutual opposition with said first zipper profile aligned with and interlockable with said third zipper profile along the entire length of said mouth, and with said second zipper profile aligned with and interlockable with said fourth zipper profile along the entire length of said mouth;

resealable means applied on a surface of said first base web in a region between said first and second zipper profiles and extending across said mouth, said resealable means having a flat profile; and a generally U-shaped slider slidably mounted to said mouth and designed to cam said first and third zipper profiles into mutual engagement, to cam said second and fourth zipper strips into mutual engagement and to reseal of said resealable means during slider travel in either direction along said mouth, said slider comprising mutually opposing first and second sidewalls, and a bridge connecting said first and second sidewalls, wherein said slider further comprises first through third plateaus projecting inwardly from said first sidewall, and fourth through sixth plateaus projecting inwardly from said second sidewall, respective portions of said first and third zipper profiles being disposed between said first and fourth plateaus, respective portions of said second and fourth zipper profiles being disposed between said third and sixth plateaus, and a portion of said resealable means being disposed between said second and fifth plateaus.

4. The storage bag as recited in claim 3, wherein said resealable means comprise a layer of adhesive material.

5. The storage bag as recited in claim 3, wherein said resealable means comprise a first layer of cohesive material, further comprising a second layer of cohesive material applied on a surface of said second base web in a region between said third and fourth zipper profiles.

6. The storage bag as recited in claim 3, further comprising a one-way valve assembly installed in an aperture in one of said first and second panels of said receptacle.

7. A storage bag comprising:

a receptacle comprising first and second panels that are either joined or connected to each other along three sides of a quadrilateral;

a first flexible plastic zipper strip comprising a first base web and first and second zipper profiles respectively joined or connected to said first base web, said first and second zipper profiles being mutually parallel, said first zipper strip not having any other zipper profile disposed between said first and second zipper profiles, and said first base web being joined to said first panel in a region extending along said mouth;

a second flexible plastic zipper strip comprising a second base web and third and fourth zipper profiles respectively joined or connected to said second base web, said third and fourth zipper profiles being mutually parallel, said second zipper strip not having any other zipper profile disposed between said third and fourth zipper profiles, said second base web being joined to said second panel in a region extending along said mouth, said first and second zipper strips being in mutual opposition with said first zipper profile aligned with and interlockable with said third zipper profile along the entire length of said mouth, and with said second zipper profile aligned with and interlockable with said fourth zipper profile along the entire length of said mouth;

a layer of adhesive material applied on a surface of said first base web in a region between said first and second zipper profiles; and a generally U-shaped slider slidably mounted to said mouth, said slider comprising first and fourth contact surfaces separated by a first gap and having respective portions of said first and third zipper profiles disposed therebetween, second and fifth contact surfaces separated by a second gap and having a respective portion of said layer of adhesive material disposed therebetween, and third and sixth contact surfaces separated by a third gap and having respective portions of said second and fourth zipper profiles disposed therebetween, wherein during slider travel in either direction along said mouth, said first and fourth contact surfaces cam said first and third zipper profiles into a mutually interlocked state, said second and fifth contact surfaces cam said layer of adhesive material into a state of adhesion with a band-shaped section of the surface of said base web of said second zipper strip in a region between the third and fourth zipper profiles of said second zipper strip, and said third and sixth contact surfaces cam said third and fourth zipper profiles into a mutually interlocked state, wherein said slider comprises mutually opposing first and second sidewalls connected by a bridge, and further comprises first through third plateaus projecting inwardly from said first sidewall, and fourth through sixth plateaus projecting inwardly from said second sidewall, said first through sixth contact surfaces being respectively disposed on said first through sixth plateaus.

8. The storage bag as recited in claim 7, further comprising a one-way valve assembly installed in an aperture in one of said first and second panels of said receptacle.

9. A storage bag comprising:

a receptacle comprising first and second panels that are either joined or connected to each other along three sides of a quadrilateral;

a first flexible plastic zipper strip comprising a first base web and first and second zipper profiles respectively joined or connected to said first base web, said first and second zipper profiles being mutually parallel, said first zipper strip not having any other zipper profile disposed between said first and second zipper profiles, and said first base web being joined to said first panel in a region extending along said mouth;

a second flexible plastic zipper strip comprising a second base web and third and fourth zipper profiles respectively joined or connected to said second base web, said third and fourth zipper profiles being mutually parallel, said second zipper strip not having any other zipper profile disposed between said third and fourth zipper profiles, said second base web being joined to said second panel in a region extending along said mouth, said first and second zipper strips being in mutual opposition with said first zipper profile aligned with and interlockable with said third zipper profile along the entire length of said mouth, and with said second zipper profile aligned with and interlockable with said fourth zipper profile along the entire length of said mouth;

a first layer of cohesive material applied on a surface of said first base web in a region between said first and second zipper profiles;

a second layer of cohesive material applied on a surface of said second base web in a region between said third and fourth zipper profiles and opposite said first layer of cohesive material; and a generally U-shaped slider slidably mounted to said mouth, said slider comprising first and second contact surfaces separated by a first gap and having respective portions of said first and third zipper profiles disposed therebetween second and fifth contact surfaces separated by a second gap and having a respective portion of said layer of adhesive material disposed therebetween, and third and sixth contact surfaces separated by a third gap and having respective portions of said second and fourth zipper profiles disposed therebetween, wherein during slider travel in either direction along said mouth, said first and fourth contact surfaces cam said first and third zipper profiles into a mutually interlocked state, said second and fifth contact surfaces cam said layers of cohesive material into a state of cohesion, and said third and sixth contact surfaces cam said third and fourth zipper profiles into a mutually interlocked state, wherein said slider comprises mutually opposing first and second sidewalls connected by a bridge, and further comprises first through third plateaus projecting inwardly from said first sidewall, and fourth through sixth plateaus projecting inwardly from said second sidewall, said first through sixth contact surfaces being respectively disposed on said first through sixth plateaus.

10. The storage bag as recited in claim 9, further comprising a one-way valve assembly installed in an aperture in one of said first and second panels of said receptacle.

* * * * *